US006088863A

United States Patent [19]

McClain et al.

[11] Patent Number: 6,088,863

[45] Date of Patent: *Jul. 18, 2000

[54] CLEANING APPARATUS

[75] Inventors: James B. McClain, Durham County, N.C.; Gary Schrebe, Midland; Kenneth Grakauskas, Sanford, both of Mich.; Timothy J. Romack, Durhama County, N.C.

[73] Assignee: MiCell Technologies, Inc., Raleigh, N.C.

[ * ] Notice: This patent is subject to a terminal disclaimer.

[21] Appl. No.: 09/233,534

[22] Filed: Jan. 20, 1999

Related U.S. Application Data

[63] Continuation of application No. 09/047,013, Mar. 24, 1998.

[51] Int. Cl.[7] ..... D06B 9/06

[52] U.S. Cl. ..... 8/159; 68/18 C; 68/58; 68/190

[58] Field of Search ..... 134/105, 200; 68/18 R, 18 C, 56, 58, 140, 24; 8/159, 158; 417/901, 370

[56] References Cited

U.S. PATENT DOCUMENTS

| | | | |
|---|---|---|---|
| 1,358,168 | 11/1920 | McCutchen . | |
| 1,455,378 | 5/1923 | Allen, Jr. . | |
| 1,878,254 | 9/1932 | Warren . | |
| 2,074,508 | 3/1937 | Hetzer | 68/38 |
| 2,357,909 | 9/1944 | Ridge . | |
| 2,816,429 | 12/1957 | Kurlancheek . | |
| 3,444,710 | 5/1969 | Gaugler et al. . | |
| 3,744,935 | 7/1973 | Magni . | |

(List continued on next page.)

FOREIGN PATENT DOCUMENTS

| | | | |
|---|---|---|---|
| 0 527 669 A1 | 2/1993 | European Pat. Off. | D06F 43/00 |
| 0 828 020 A2 | 3/1998 | European Pat. Off. | D06F 43/00 |
| 0 828 020 A3 | 3/1998 | European Pat. Off. | D06F 43/00 |
| WO 97/33031 | 9/1997 | WIPO . | |
| WO 99/13148 | 3/1999 | WIPO . | |

OTHER PUBLICATIONS

PCT International Search Report for Int'l Appl'n No. PCT/US 99/06383, dated Jul 22, 1999.

*Primary Examiner*—Frankie L. Stinson
*Attorney, Agent, or Firm*—Myers Bigel Sibley & Sajovec

[57] ABSTRACT

A wash tank adapted for use with a carbon dioxide cleaning medium has a body member having a front opening formed therein, the body member having side walls and a back wall opposite the front opening. The side walls terminate in a front body member edge portion that defines the front opening. The edge portion serves in the sealing mechanism, as discussed below. A substantially cylindrical basket is disposed within the body member for rotation about a generally horizontal axis. The basket has a front opening formed therein, and has a side wall and a back wall opposite the front opening. The basket side wall terminates in a front basket edge portion defining the basket front opening. The said basket edge portion is spaced forward from the body member edge portion when the basket is positioned in the body member, serving to prevent loose garments or materials placed within the basket from becoming caught in the seal and interfering with seal integrity. A drive mechanism is included to rotate the basket about the axis. A door is hingeably connected to the body member, with the door having a front wall and side walls, and with the side walls terminating in an inner edge portion configured to abut said body member edge portion. The door inner edge portion and the body member edge portion comprise a seal for sealing the door and body member to form an enclosed pressure vessel. A lock mechanism is connected to the body member and configured to sealably connect the body member outer edge portion with the door inner edge portion when the door is in a closed position. A plug is connected to the door, the plug having a surface portion configured to abut the basket front opening when the door is closed, yet permitting rotation of the basket within the body member while preventing items within the said basket from escaping during rotation of said basket.

12 Claims, 9 Drawing Sheets

U.S. PATENT DOCUMENTS

| | | | |
|---|---|---|---|
| 4,012,194 | 3/1977 | Maffei | 8/142 |
| 5,214,925 | 6/1993 | Hoy et al. . | |
| 5,267,455 | 12/1993 | Dewees et al. | 68/5 C |
| 5,339,844 | 8/1994 | Sanford, Jr. et al. | 134/107 |
| 5,368,171 | 11/1994 | Jackson . | |
| 5,402,648 | 4/1995 | Longsworth . | |
| 5,412,958 | 5/1995 | Iliff et al. . | |
| 5,467,492 | 11/1995 | Chao et al. | 8/159 |
| 5,526,834 | 6/1996 | Mielnik et al. . | |
| 5,651,276 | 7/1997 | Purer et al. | 68/5 C |
| 5,669,251 | 9/1997 | Townsend et al. | 68/58 |
| 5,759,209 | 6/1998 | Adler et al. . | |
| 5,772,783 | 6/1998 | Stucker . | |
| 5,822,818 | 10/1998 | Chao et al. . | |
| 5,850,747 | 12/1998 | Roberts et al. . | |
| 5,943,721 | 8/1999 | Lerette et al. | 8/158 |
| 5,970,554 | 10/1999 | Shore et al. | 8/158 |

CLEANING APPARATUS

This application is a continuation of patent application Ser. No. 09/047,013 filed Mar. 24, 1998, still pending.

FIELD OF THE INVENTION

The present invention concerns washing and dry cleaning apparatus, and articularly concerns dry cleaning apparatus for use with carbon dioxide based dry cleaning systems.

BACKGROUND OF THE INVENTION

Numerous different apparatus for washing garments and fabrics are known. Examples of patents on washing machines include U.S. Pat. No. 1,358,168 to McCutchen, U.S. Pat. No. 1,455,378 to Allen, U.S. Pat. No. 2,357,909 to Ridge, U.S. Pat. No. 2,816,429 to Kurlancheek, and U.S. Pat. No. 3,444,710 to Gaugler. Such apparatus is, in general, adapted to home use with water-based cleaning systems.

Non-aqueous cleaning apparatus, known as "dry cleaning" apparatus, is also known. Dry cleaning employs an organic solvent such as perchloroethylene in place of an aqueous system. Dry cleaning apparatus is not, in general, employed in the home, and is instead situated at a store or central plant. Problems with convention dry-cleaning systems include the toxic nature of the solvents employed.

Carbon dioxide has been suggested as a dry cleaning medium. See, e.g., U.S. Pat. No. 4,012,194 to Maffei. To date, however, a feasible apparatus for carrying out carbon dioxide cleaning has not been provided. One apparatus is described in U.S. Pat. No. 5,467,492 to Chao et al. This apparatus has apparently been supplanted by the apparatus described in U.S. Pat. No. 5,669,251 to Townsend et al. Townsend describes a dry cleaning system having a hydraulically rotated basket that rests on roller bearings. The system is adapted to use with liquid carbon dioxide. Manifolds are disposed between an outer pressure vessel and the basket and have nozzles that produce jets of liquid carbon dioxide that agitate the garments. The basket is said to be rotated by the friction of the garments against the basket walls (column 4, lines 47–48) or by a paddle wheel or turbine (col. 5, lines 8–9). A disadvantage of Townsend is that the basket is supported by roller bearings around the periphery of the basket, which are complex and prevent simple removal of the basket for cleaning, inspection, etc. A further disadvantage is that no practical means of closing and sealing the vessel is disclosed. Since the vessel is pressurized with carbon dioxide, it is critical that any access door be suitably sealed, and it is critical that any loose garments or other materials not inadvertently fall between seal members and leave the door partially unsealed when the vessel is filled with carbon dioxide. A further disadvantage of Townsend is that roller bearings are required between the basket side wall and the side wall of the pressure vessel. Since roller bearings are relatively large, this increases the "dead space" between the side wall of the basket and the side wall of the pressure vessel, which dead space must be filled with liquid that is not operating to clean clothing within the basket.

U.S. Pat. No. 5,267,455 to Dewees et al. describes a dry cleaning system in which carbon dioxide as a cleaning medium is transferred between vessels by means of a second purge gas such as nitrogen. The use of multiple pressurized gases makes the system considerably more complex. The system employs a rotating basket, but a disadvantage is that the basket is rotated by means of a magnet coupling.

Accordingly, there is a continued need for a feasible dry cleaning apparatus that can be used with a carbon dioxide-based cleaning medium.

SUMMARY OF THE INVENTION

A first object of the present invention is to provide a cleaning apparatus adapted for use with a carbon dioxide cleaning medium that includes an access door which will not be easily blocked by stray articles of clothing and the like.

A second object of the present invention is to provide a carbon dioxide dry cleaning system that provides a rapid turnover of cleaning fluid to the articles being cleaned.

A third object of the present invention is to provide a cleaning apparatus for use with a carbon dioxide cleaning medium that incorporates a rotating basket without adding bearings or shafts that interfere with either the provision of a suitable access door or the reduction of dead space.

A fourth object of the present invention is to provide a cleaning apparatus for use with a carbon dioxide cleaning medium that incorporates a fluid, or turbine, drive for a rotating basket.

In accordance with the foregoing, a wash tank, or cleaning vessel, adapted for use with a carbon dioxide cleaning medium is provided. The tank has a body member having a front opening formed therein, the body member having side walls and a back wall opposite the front opening. The side walls terminate in a front body member edge portion that defines the front opening. The edge portion serves in the sealing mechanism, as discussed below. A substantially cylindrical basket is disposed within the body member for rotation about a generally horizontal axis. The basket has a front opening formed therein, and has a side wall and a back wall opposite the front opening. The basket side wall terminates in a front basket edge portion defining the basket front opening. The said basket edge portion is spaced forward from the body member edge portion when the basket is positioned in the body member, serving to prevent loose garments or materials placed within the basket from becoming caught in the seal and interfering with seal integrity. A drive mechanism is included to rotate the basket about the axis. A door is hingeably connected to the body member, with the door having a front wall and side walls, and with the side walls terminating in an inner edge portion configured to abut said body member edge portion. The door inner edge portion and the body member edge portion comprise a seal for sealing the door and body member to form an enclosed pressure vessel. A lock mechanism is connected to the body member and configured to sealably connect the body member outer edge portion with the door inner edge portion when the door is in a closed position. A plug is connected to the door, the plug having a surface portion configured to abut the basket front opening when the door is closed, yet permitting rotation of the basket within the body member while preventing items within the said basket from escaping during rotation of said basket.

A problem with prior devices is the need for roller bearings between the basket and the body member. Not only does this increase dead space as discussed above, but roller bearings can be difficult to implement when the basket extends forward of the body member as described above. Accordingly, in a preferred embodiment, an elongate shaft is connected to the basket back wall and coincident with said axis, and a shaft support is connected to the body member back wall. The shaft is disposed in the shaft support to permit rotation of the basket within the body member. This obviates roller bearings between the basket and the body member side wall.

A second aspect of the invention is a method for cleaning articles with a carbon dioxide cleaning medium. The method comprises:

(a) providing a cleaning vessel, the vessel comprising: a body member having an enclosed chamber formed therein; a substantially cylindrical basket disposed within the enclosed chamber for rotation about a generally horizontal axis with the articles to be cleaned contained therein, the basket having a front opening formed therein, the basket having a side wall and a back wall opposite the front opening, the side wall terminating in a front basket edge portion defining the basket front opening; a plurality of blade members connected to the basket back wall; and at least one nozzle (e.g., a single nozzle for each direction of rotation) connected to the body member and configured to direct a stream of liquid carbon dioxide cleaning medium at the blade members to rotate the basket; (b) pumping a stream of liquid carbon dioxide cleaning medium through the at least one nozzle at the blade members to rotate the basket; and (c) draining the liquid carbon dioxide from the enclosed chamber during the pumping step at a rate so that articles in the basket contact both the liquid carbon dioxide cleaning medium and a gas phase while being rotated in the basket. The stream of liquid carbon dioxide cleaning medium is preferably pumped at an amount of 20 to 200 gallons per minute. Preferably, the stream of liquid carbon dioxide cleaning medium is pumped at an amount per minute not greater than twice the volume of the enclosed chamber. In general, the stream of liquid carbon dioxide being pumped at an amount per minute sufficient to impart at least 50 foot-pounds of rotational torque to the basket. Apparatus for carrying out the method is also disclosed.

A third aspect of the present invention is a cleaning apparatus adapted for use with a carbon dioxide cleaning medium, and useful for implementing the foregoing methods and apparatus. The apparatus comprises: a body member having an opening formed therein, the body member having side walls and a back wall opposite the opening, the side walls terminating in a body member edge portion defining the opening; a basket disposed within the body member for rotation about an axis; drive means for rotating the basket about the axis; a door hingeably connected to the body member, the door having a front wall and side walls, with the side walls terminating in an inner edge portion configured to abut the body member edge portion; a lock mechanism connected to the body member and configured to sealably connect the body member outer edge portion with the door inner edge portion when the door is in a closed position to define an enclosed chamber containing the basket; a supply line serving as supply means for supplying a liquid carbon dioxide cleaning medium to the enclosed chamber; drain means for draining a liquid carbon dioxide cleaning medium from the enclosed chamber; and a vent line serving as a vent means for venting carbon dioxide gas from the enclosed chamber while the door is in a closed position, prior to opening the door.

A fourth aspect of the present invention is a method of operating a cleaning apparatus adapted for use with a carbon dioxide cleaning medium. The method comprises the steps of:

providing a working vessel to supply carbon dioxide cleaning medium and a wash tank to receive carbon dioxide cleaning medium, the wash tank including a drain and a rotating basket, the rotating basket containing articles to be cleaned;

partially filling the wash tank by transferring (e.g., by pumping or gravity flow) liquid carbon dioxide cleaning medium from the working vessel to the wash tank to at least partially immerse the articles to be cleaned in the carbon dioxide cleaning medium;

washing the articles by pumping liquid carbon dioxide cleaning medium from the wash tank drain through at least one filter and back into the wash tank as a stream of liquid carbon dioxide cleaning medium, with the basket being rotated by the stream; then draining the liquid carbon dioxide cleaning medium from the wash tank back to the working vessel so that the articles to be cleaned are no longer immersed in the liquid carbon dioxide cleaning medium; and then extracting liquid carbon dioxide cleaning medium from the articles by pumping liquid carbon dioxide cleaning medium from the wash tank drain and back into the wash tank as a stream of liquid carbon dioxide cleaning medium, the extracting step being carried out by spinning the basket with the stream.

Gas-phase communication (within the closed system) is provided between the working vessel and the wash tank during the partially filling step, and between the working vessel and the wash tank during the draining step. Preferably, the extracting step is followed by the step of recapturing carbon dioxide gas from the wash tank by transferring (e.g., by compressing, condensing, or combinations thereof) high pressure carbon dioxide gas from the wash tank back to the working vessel. The recapturing step is optionally followed by the step of venting low pressure carbon dioxide gas from the wash tank, after which the wash tank may be opened.

A fifth aspect of the invention system for implementing the foregoing operating method for cleaning articles with a carbon dioxide cleaning medium. The system comprises a working vessel for supplying carbon dioxide cleaning medium; a wash tank for receiving carbon dioxide cleaning medium, the wash tank having a rotating basket disposed therein, the wash tank including a drain; a fill line connecting the working vessel to the wash tank; a pump positioned on the fill line for pumping liquid carbon dioxide cleaning medium from the working vessel to the wash tank; a wash line connecting the pump to the wash tank; a vent line connecting the working vessel to the wash tank; and a drain line connecting the wash tank to the pump.

The foregoing and other objects and advantages of the present invention are explained in detail in the drawings herein and the specification set forth below.

DETAILED DESCRIPTION OF THE PREFERRED EMBODIMENTS

Articles that can be cleaned by the apparatus of the present invention are, in general, garments and fabrics (including woven and non-woven) formed from materials such as cotton, wool, silk, leather, rayon, polyester, acetate, fiberglass, furs, pelts, canvas, neoprene, etc., formed into items such as clothing, work gloves, tents, parachutes, sails, hats, tapestry, waders, rags, leather goods (e.g., boots, shoes, handbags and brief cases), etc.

The term "clean" as used herein refers to any removal of soil, dirt, grime, or other unwanted material, whether partial or complete. The invention may be used to clean nonpolar stains (i.e., those which are at least partially made by nonpolar organic compounds such as oily soils, sebum and the like), polar stains (i.e., hydrophilic stains such as grape juice, coffee and tea stains), compound hydrophobic stains (i.e., stains from materials such as lipstick and candle wax), and particulate soils (i.e., soils containing insoluble solid components such as silicates, carbon black, etc.).

Note that gas and medium can be transferred between various elements of the invention, and gas communication can be provided between elements of the invention, both directly (e.g., by a single line or a combination of lines and valves) without intervening elements such as tanks, pumps, condensers, compressors and the like, or indirectly through such intervening elements.

Figure 1:
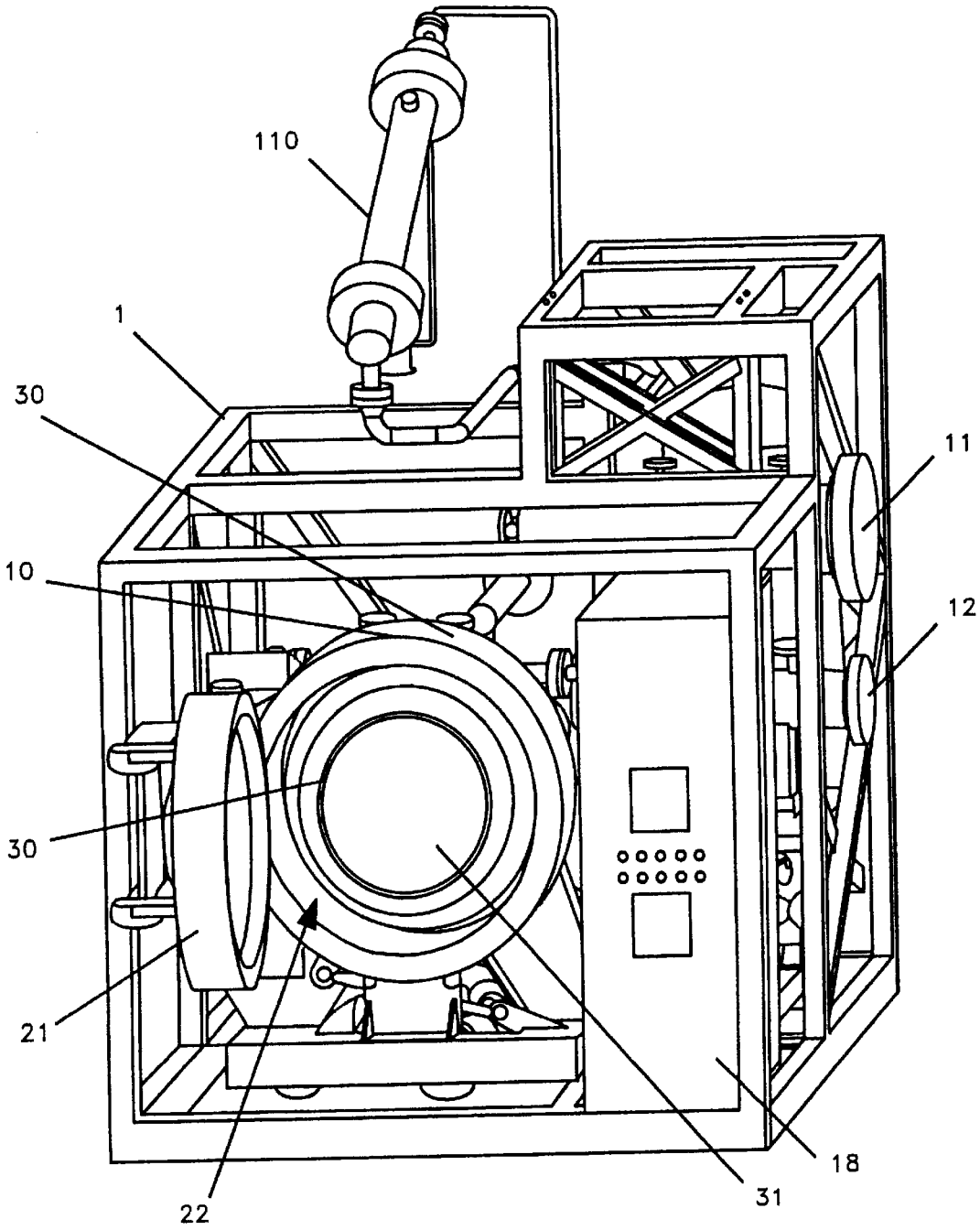
FIG. 1 is a front perspective view of an apparatus of the present invention, with the door to the wash tank shown in an open position.
Figure 2:
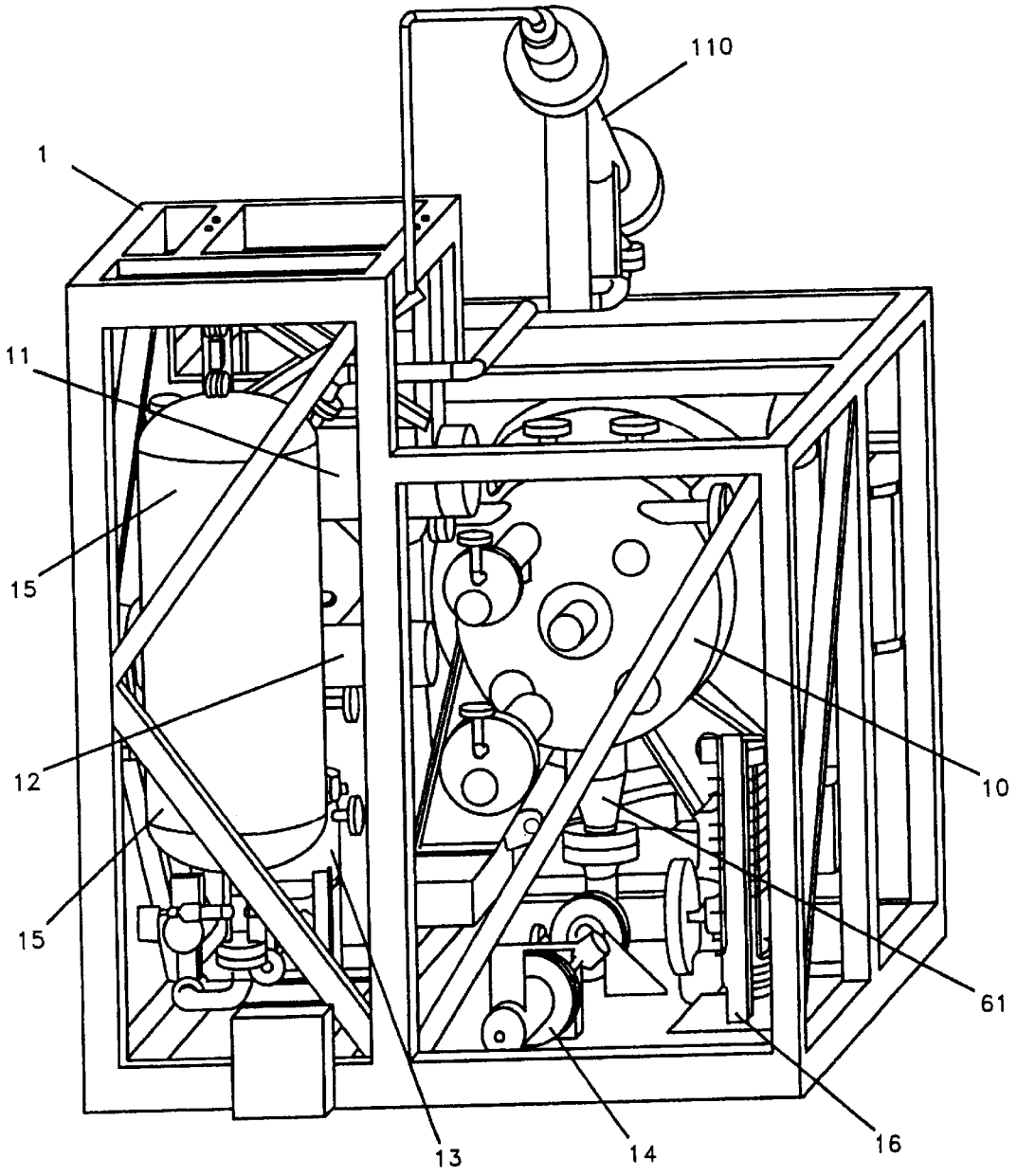
FIG. 2 is a rear perspective view of an apparatus of the present invention.

A basic layout for various elements of an apparatus of the present invention is shown in FIGS. 1–2. The apparatus includes a support frame 1, a wash tank 10, a carbon filter 11, a lint filter 12, a still 13, a pump 14, a working vessel 15, a compressor 16, and condenser 110, bulk carbon dioxide storage vessel, not shown (see FIG. 13 no. 17), can be provided by a commercial distributor and replaced and/or refilled as necessary. A control box 18 contains instrumentation for controlling the apparatus and the operator-machine interface. The wash tank includes a door connected to a body member by means of a hinge, a lock mechanism and an inner rotating basket.

Note from FIGS. 1–2 that pump 14 is located below the level of the wash tank 10. Preferably, the center axis of the pump 14 is located at least 2 to 3 feet below the bottom level of the wash tank. The spacing of the pump substantially below the bottom level of the wash tank is advantageous because the liquid cleaning medium is being pumped at a temperature above its boiling point, and this spacing helps to reduce potentially damaging cavitation during pumping.

The wash tank itself is shown in greater detail in FIGS. 3–6. The wash tank has a body member 20 and a door member 21, which in these figures is shown in a closed and sealed position to provide an enclosed pressure vessel having an inner chamber formed therein. The body member has a front opening 22 formed therein, side walls 23 and an outwardly convex back wall 24 opposite the front opening. The side walls terminate in a front body member edge portion 25 that defines the front opening. The edge portion serves in the sealing mechanism, as discussed below.

The door is hingeably connected to the body member by means of hinge 26. The door has an outwardly convex front wall 27 and side walls 28, and with the side walls terminating in an inner edge portion 29 configured to abut the body member edge portion.

The door inner edge portion and the body member edge portion comprise a seal for sealing the door and body member to form an enclosed pressure vessel. A lock mechanism is connected to the body member and configured to sealably connect the body member outer edge portion with the door inner edge portion when the door is in a closed position.

The door is hinged on the pressure vessel and is physically closed by a person. Any suitable closing mechanism can be employed, including automatic or hydraulic closing mechanisms. In one embodiment, when the door is pushed far enough closed a relay is energized that signals to a controller that the door is ready to be locked in place. A hydraulic cylinder is energized by the controller to engage a rotating locking ring within the locking mechanism into place against wedges that press the door up against the head section of the pressure vessel. A seal is made via an O-ring that is compressed when the locking ring is moved into place. The door includes instrumentation that does not allow it to be opened until pressure is sufficiently released from the enclosed chamber formed therein.

Figure 6:
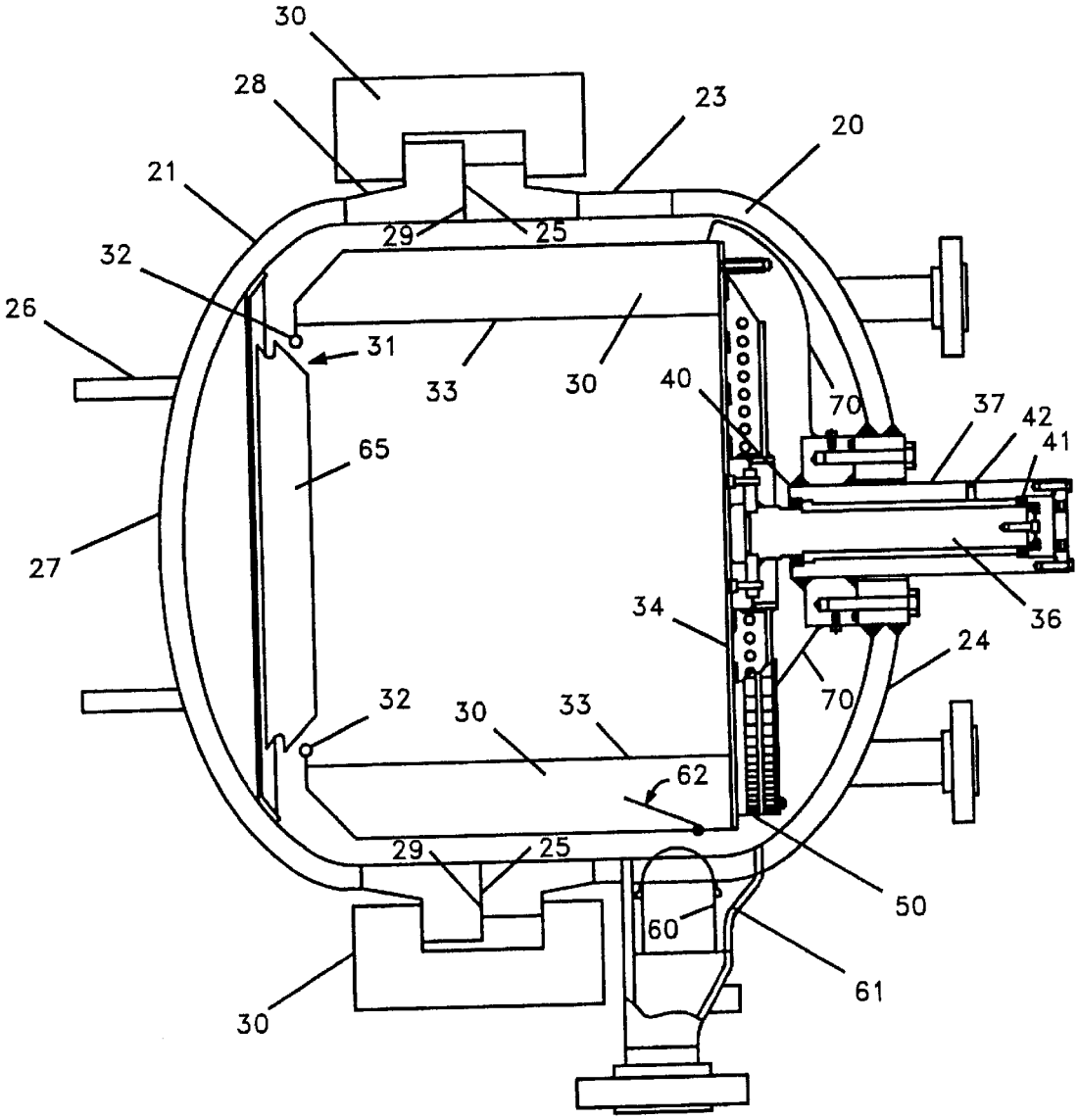
FIG. 6 is a right sectional elevation view of a wash tank of the present invention.
Figure 9:
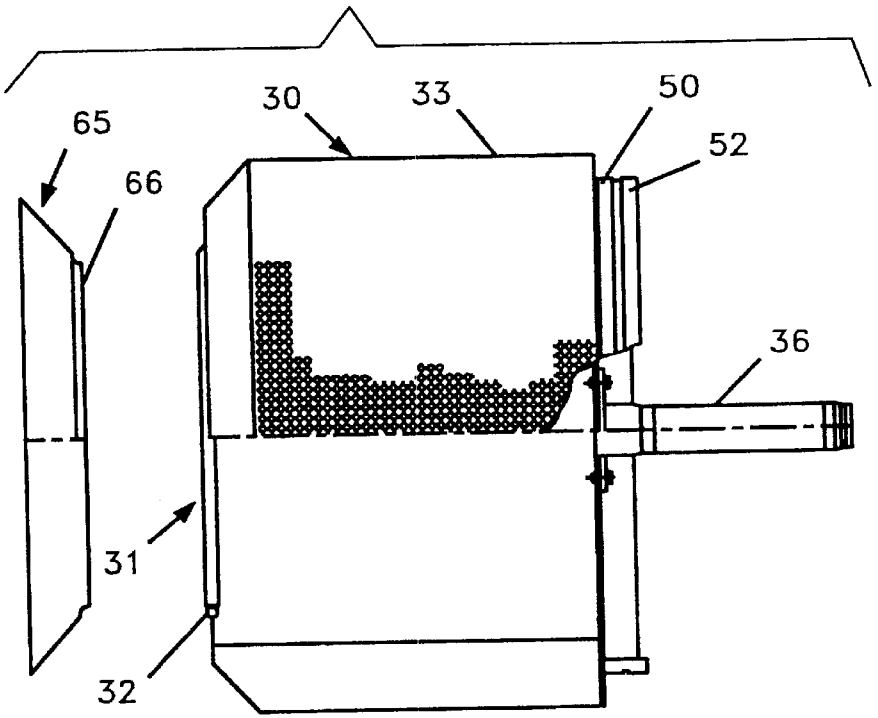
FIG. 9 is a side view of a rotating basket of the present invention in partially cut-away view, with the door plug shown exploded therefrom.
Figure 8:
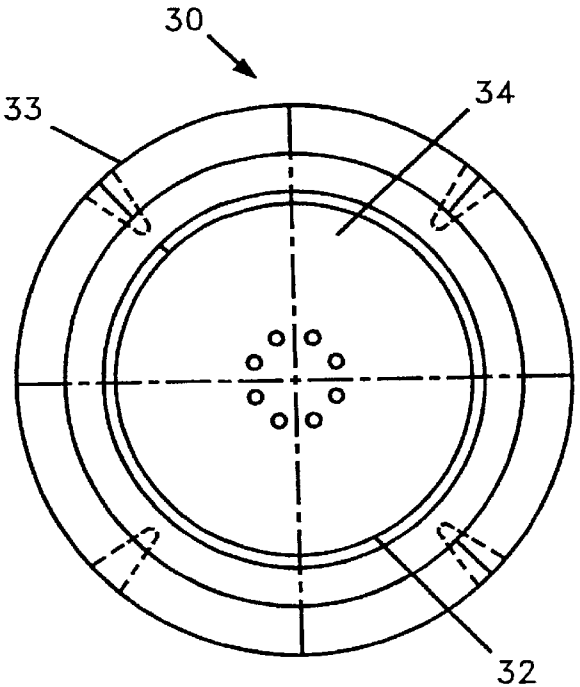
FIG. 8 is a front end view of a rotating basket of the present invention.

As shown in FIG. 6 and FIGS. 8–9, a substantially cylindrical basket 30 is disposed within the body member for rotation about a generally horizontal axis. The basket is preferably perforated, as illustrated in part in FIG. 9. The basket has a front opening 31 formed therein; and has a side wall 33 and a back wall 34 opposite the front opening. The basket side wall terminates in a front basket edge portion 32 defining the basket front opening. Note that the basket front edge portion 32 is spaced forward from the body member edge portion 25 when the basket is positioned in the body member. This serves to prevent loose garments or materials placed within the basket from becoming caught in the seal formed between edge portions 25 and 29 and interfering with seal integrity.

Figure 7:
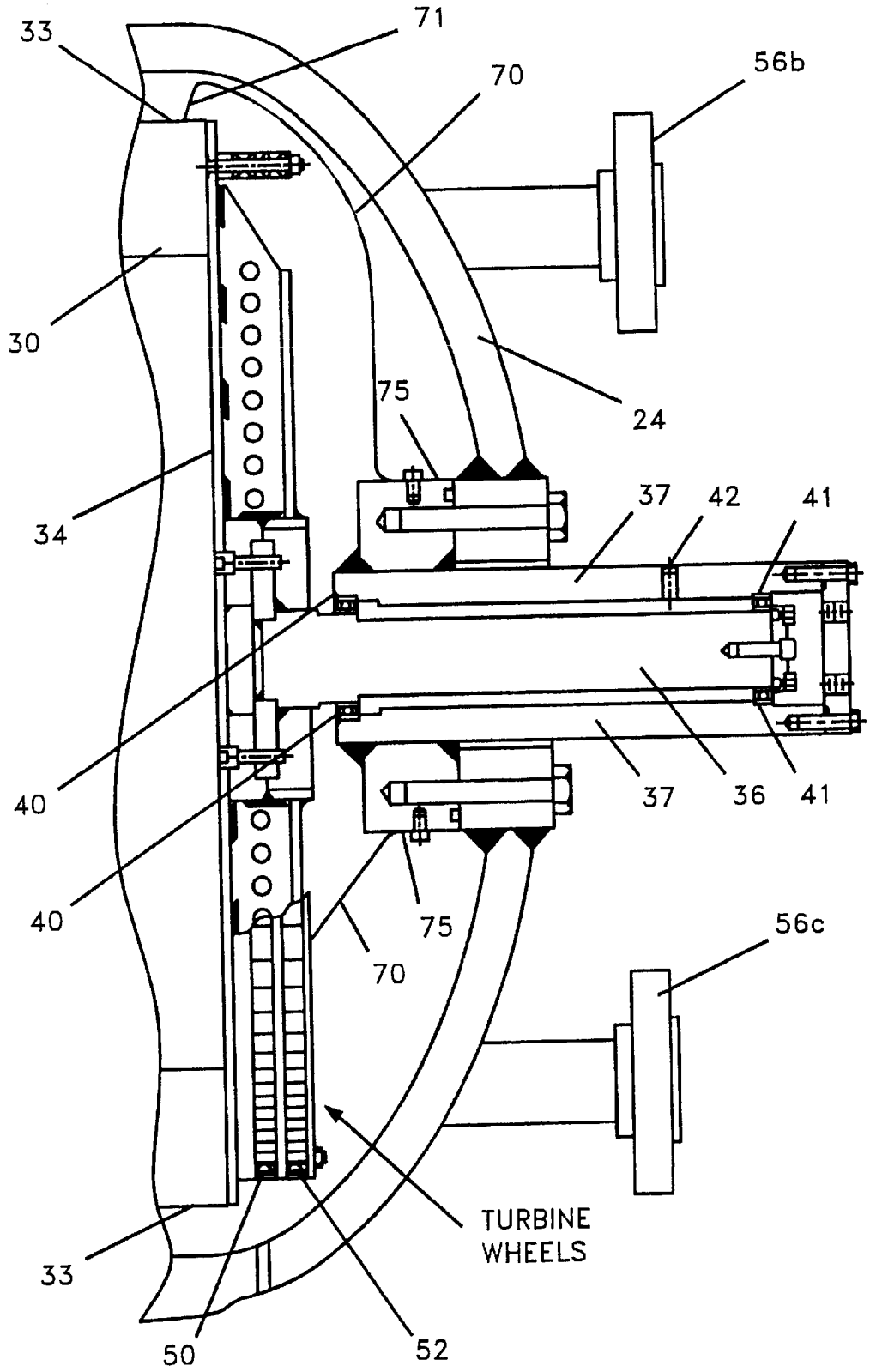
FIG. 7 is a detail view of a bearing cartridge holder and turbine blade assembly, with the turbine blades shown in partially cut-away view.

A problem with prior devices is the need for roller bearings between the basket and the body member. Not only does this increase dead space as discussed above, but roller bearings can be difficult to implement when the basket extends forward of the body member as described above. Accordingly, in a preferred embodiment as shown in FIGS. 6–7, an elongate shaft 36 is connected to the basket back wall. The shaft is coincident with the axis of rotation of the basket. A shaft support in the form of a bearing cartridge holder 37 is connected to the body member back wall. The shaft is disposed in the cartridge holder 37 to permit rotation of the basket within the body member. The bearing cartridge is a cantilevered bearing cartridge, which may be comprised of ball bearings (40, 41 as illustrated), roller bearings, sleeve bearings or any other suitable bearing system. Suitable balls for ball bearings are available from Barden Corp., 200 Park Avenue, P.O. Box 2449, Danbury, Conn., 06813-2449. Ball bearings are preferably made from a ceramic (silicon nitride). The bearing cartridge is fastened to a cartridge plate, which is in turn fastened to the back of the cartridge holder.

An opening 42 in the side wall of the bearing cartridge holder allows the liquid medium to be pumped directly into the bearing cartridge, for example from the same pump that supplies cleaning solution to the turbine wheel blades (discussed below), for the purpose of lubricating the bearing during operation of the apparatus.

Figure 10:
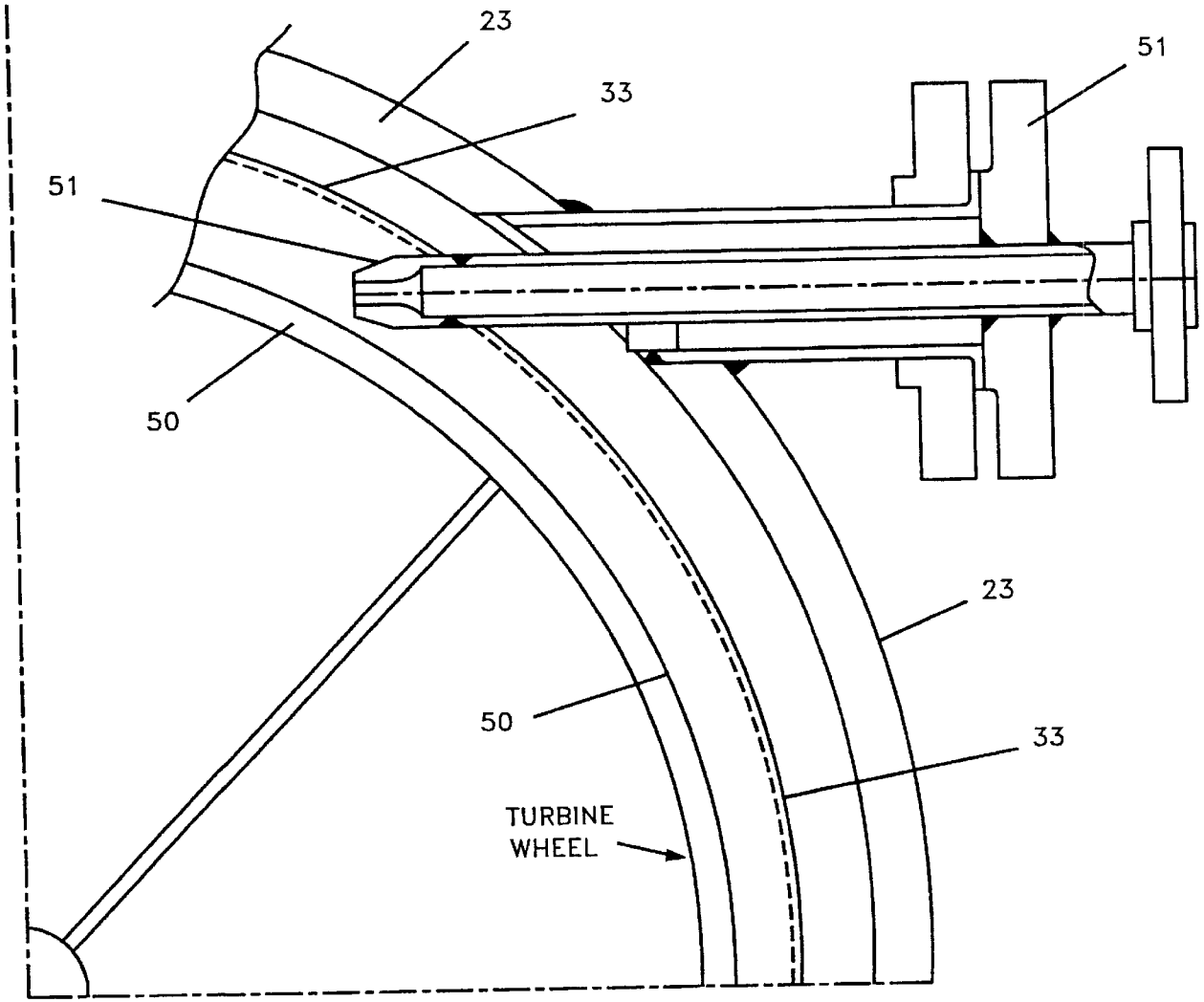
FIG. 10 is a detail sectional view of a turbine wheel and nozzle of the present invention in the wash tank.
Figure 12:
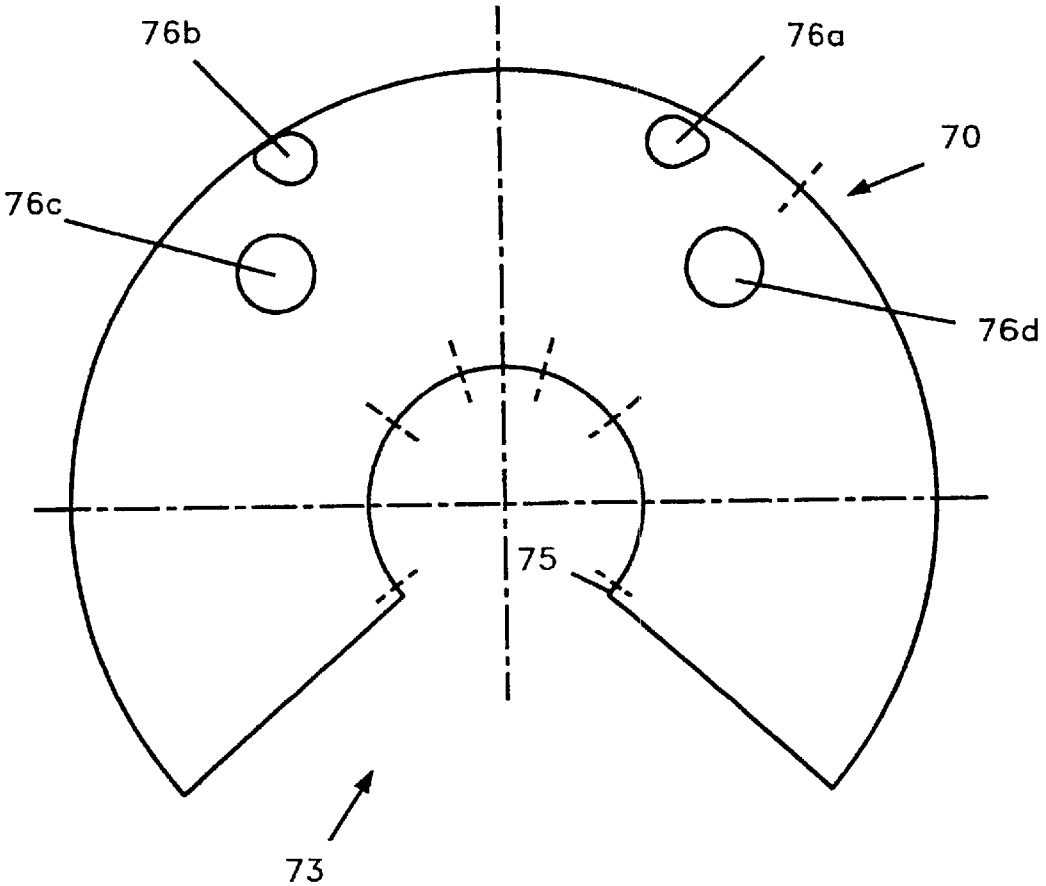
FIG. 12 is a front view of a splash guard of the present invention.
Figure 11:
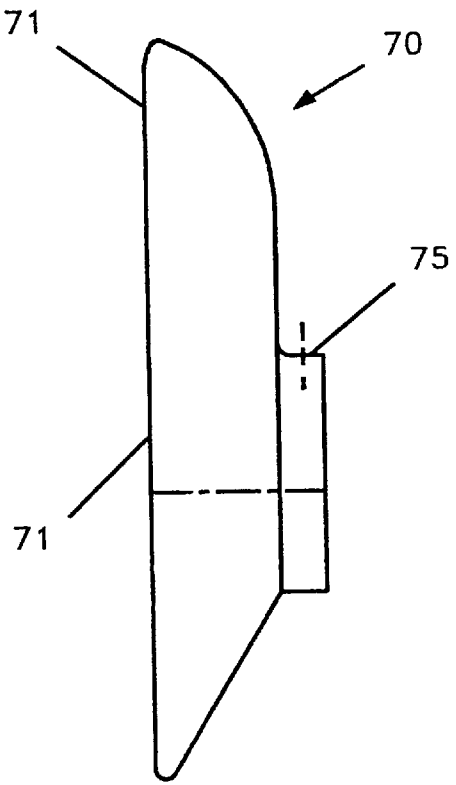
FIG. 11 is a side view of a splash guard employed in the present invention.

As shown in FIGS. 6–7 and FIG. 10, a turbine wheel 50 comprising a plurality of blade members is connected to the back wall of the basket. A nozzle 51 connected to the body member and configured to direct a stream of liquid carbon dioxide cleaning medium at the blade members and thereby rotates the basket. Together, the nozzle and blade members provide a drive means for rotating the basket. When installed, a carbon dioxide pump 14 is connected to the nozzle to supply liquid carbon dioxide thereto. Turbine wheels and carbon dioxide pumps are obtained from manufacturers such as Barber Nichols Manufacturing, 6325 West 55th Avenue, Arvada, Colo. 80002 USA. Optionally, but preferably, a second, oppositely facing turbine wheel 52 is mounted to the basket and a second, oppositely facing nozzle is connected to the body member, so that the basket can be rotated in two directions. It will be appreciated by those skilled in the art that the turbine wheel can be connected directly to the basket as illustrated, or can be indirectly connected to the basket by means of a gears, belts, etc. Numerous other drive mechanisms can optionally be employed as the drive means, such as a motor external to the pressure vessel, which motor may be an electric motor, driven by liquid carbon dioxide, etc. However, an advantage of the illustrated embodiment is that the carbon dioxide cleaning medium can be drained from the apparatus through the drain opening provided, and returned to the pump to be pumped back to the nozzle.

Figure 5:
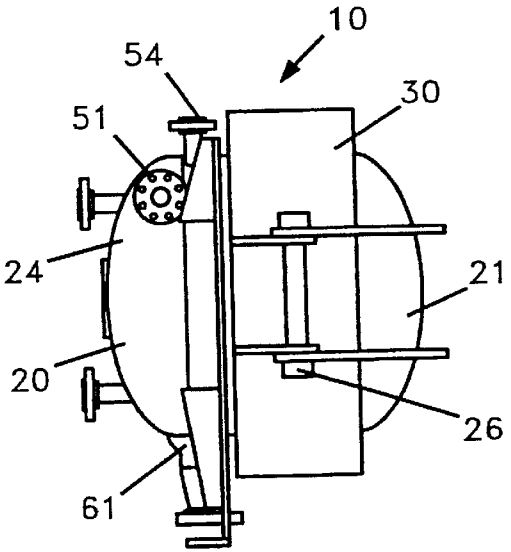
FIG. 5 is a left elevation view of a wash tank of the present invention.
Figure 4:
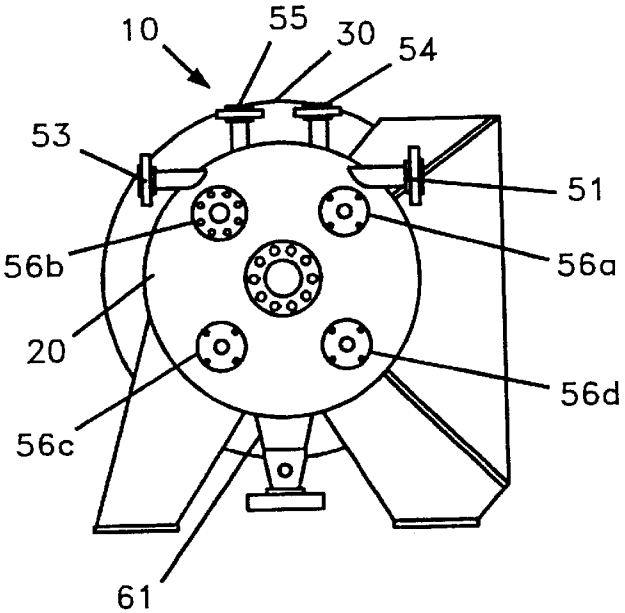
FIG. 4 is a rear elevation view of wash tank of the present invention.
Figure 3:
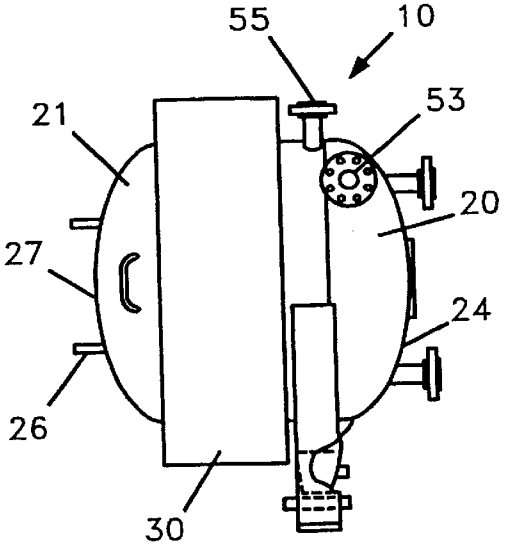
FIG. 3 is a right elevation view of a wash tank of the present invention.

As shown in FIGS. 3–5, the body member has nozzles 51, 53 (the reverse nozzle) connected thereto, an access port 54 for a vent and gas communication line, a general inlet port 55 for dumping medium onto the basket without causing rotation of the basket, and other inlet portsion 56*a*–56*d* for temperature probes, pressure probes, material addition, etc.

As best seen in FIG. 6, to prevent buttons or other objects from damaging the carbon dioxide pump, a button trap 60 or strainer is incorporated into the drain 61. The drain itself has a volume of about seven gallons, so ample space within the drain is available for a button trap. A locking mechanism is preferably included on the button trap (which is pail-shaped) so that it is locked in place by a quarter or half turn. Advantageously, an inwardly opening trap door 62 is provided on the side wall of the rotating basket to allow access to the button trap for periodic cleaning thereof. The trap door includes a locking means, which in a preferred embodiment is a simple magnet lock formed from permanent magnets mounted on either the trap door or the rotating basket, opposite a portion on the opposite member that is magnetically engaged by the magnets.

As shown in FIG. 6 and FIG. 9, a plug 65 is connected to the door, the plug having a surface portion 66 configured to abut the basket front opening when the door is closed. The abutting surface portion permits rotation of the basket within the body member, yet prevents items within the said basket from escaping during rotation of said basket. The plug is formed of sheet metal, and the space behind the plug can be filled in whole or in part with a suitable material, such as sand or glass beads, to reduce dead volume within the wash tank.

The foregoing apparatus is constructed and code stamped per the latest edition of ASME Section VIII Div. 1. All nozzle bolt holes straddle the major vessel centerlines unless specifically noted otherwise. All nozzle gasket surfaces require a surface finish of 125 to 250 rms. Scribing or center punching of work lines or centerlines is prohibited. All sharp edges are broken. All wetted surfaces are to be 304 stainless steel or greater. In the alternative, wetted surfaces may be formed from a lower grade of steel such as carbon steel that is coated, cladded, plated or lined with a material that makes it suitable for the intended purposes, for example nickel, stainless steel, polymeric coatings such as polytetrafluoroethylene, polychlorotrifluoroethylene, polytetrafluoroethylene-co-ethylene, perfluoroalkoxy resin, epoxy, nickel/ptfe, ceramic, etc. Stainless steel is currently preferred for wetted surfaces.

It is necessary to provide a splash guard or control means to keep clothes within the basket from being wetted with carbon dioxide during the spin and extraction cycle of the wash process. Note that the turbine rings are mounted on the back of the basket, which has a back that is not perforated. A fixed, dished, sheet metal splash guard 70 is mounted to the back of the tank by mounting portion 75 and extends to an edge portion 71 that abuts the side wall 33 of the rotating drum, and isolates the fluid that drives the turbine wheel from entering the main chamber of the basket (where the articles to be cleaned are located). A fixed seal may optionally be incorporated between the edge portion of the splash guard and the rotating basket. The shield has a section cut out near the bottom thereof to form an opening 73 that allows the fluid to drain to the wash tankdrain 61. Other openings 76*a*–76*d* are provided in the splash guard for ports and nozzles. The drain is located as far to the back of the wash tank as possible so that the fluid does not have an opportunity to build up in the bottom of the tank. Note that liquid will not enter the basket if the basket is spinning at a sufficient speed, so the splash guard may be removed if other splash guard or control means such as low-drag bearings are employed, or the basket is kept spinning at a sufficient rate while the flow of liquid carbon dioxide is reduced (e.g., by providing valves that immediately stop the stream of cleaning medium, rather than a gradual reduction in force of the stream).

In use, a method for dry-cleaning articles such as fabrics and clothing in carbon dioxide in an apparatus of the present invention typically comprises placing the article (or typically a group of articles) in the basket, closing the door, and then partially filling the vessel with carbon dioxide cleaning medium. Rotating of the basket by pumping liquid carbon dioxide cleaning medium through the nozzle at the turbine wheel is then initiated, thereby contacting an article to be cleaned with a liquid dry cleaning composition for a time sufficient to clean the fabric.

Preferably, the stream of liquid carbon dioxide cleaning medium is pumped through the nozzle (or nozzles, if multiple nozzles are directed at the turbine blades) at an amount of 20, 40 or 50 gallons per minute up to 100 or 200 gallons per minute, so that at least 40 or 50 (and preferably 65) foot-pounds of rotational torque is thereby imparted to the basket at the start of rotation. In general, the stream of liquid carbon dioxide is pumped at an amount per minute not greater than twice the volume of the enclosed chamber, and is preferably pumped at an amount per minute of at least once, and not greater than twice the volume of liquid carbon dioxide cleaning medium in the enclosed chamber (which is less than the total volume of the enclosed chamber so that a partial vapor or gas phase is provided therein). This advantageously provides a rapid turnover of the cleaning medium.

For pumping the liquid carbon dioxide cleaning medium, a canned motor pump is preferably employed. As explained in greater detail below, a line or "loop" carrying the liquid carbon dioxide cleaning medium is run from the outlet of the pump, through the lint filter, and back through the motor housing. This fluid serves to insure a flow of fluid over the internal bearings as well as provide heat transfer from the rotor and stator windings.

Any carbon dioxide liquid dry-cleaning composition can be used as the medium in the instant apparatus. See, e.g., U.S. Pat. No. 4,012,194 to Maffei. In the instant apparatus, carbon dioxide is supplied by tank 17, and additional ingredients can be added to the carbon dioxide in the working vessel (which may optionally be supplied with a stirrer to serve as a mixing means therein), in the wash tank, or any other suitable location in the system (or combination thereof).

In a preferred embodiment, the liquid dry-cleaning medium comprises a mixture of: (a) water, (b) carbon dioxide, (c) surfactant, and, optionally but preferably, (d) an organic co-solvent. After the contacting step, the article is separated from the liquid dry cleaning composition. Preferably, the liquid dry cleaning composition is at ambient temperature, of about 0° C to 30° C. In one embodiment; the surfactant contains a $CO_2$-philic group; in another embodiment, the surfactant does not contain a $CO_2$-philic group.

A preferred liquid carbon dioxide dry-cleaning medium useful for carrying out the present invention typically comprises:

(a) from 0.1 to 10 percent (more preferably from 0.1 to 4 percent) water;

(b) carbon dioxide (to balance; typically at least 30 percent);

(c) surfactant (preferably from 0.1 or 0.5 percent to 5 or 10 percent); and (d) from 0.1 to 50 percent (more preferably 4 to 30 percent) of an organic co-solvent.

Percentages herein are expressed as percentages by weight unless otherwise indicated.

The medium is provided in liquid form at ambient, or room, temperature, which will generally be between zero and 50° Centigrade. The medium is held at a pressure that maintains it in liquid form within the specified temperature range. The washing or cleaning step is preferably carried out with the liquid medium at ambient temperature within the wash tank, without extraneous heating or cooling of the wash tank.

The organic co-solvent is, in general, a hydrocarbon co-solvent. Typically the co-solvent is an alkane co-solvent, with $C_{10}$ to $C_{20}$ linear, branched, and cyclic alkanes, and mixtures thereof (preferably saturated) currently preferred. The organic co-solvent preferably has a flash point above 140° F., and more preferably has a flash point above 170° F. The organic co-solvent may be a mixture of compounds, such as mixtures of alkanes as given above, or mixtures of one or more alkanes in combination with additional compounds such as one or more alcohols (e.g., from 0 or 0.1 to 5% of a C1 to C15 alcohol (including diols, triols, etc.)).

Any surfactant can be used to carry out the present invention, including both surfactants that contain a $CO_2$-philic group (such as described in PCT Application WO96/27704) linked to a $CO_2$-phobic group (e.g., a lipophilic group) and surfactants that do not contain a $CO_2$-philic group (i.e., surfactants that comprise a hydrophilic group linked to a hydrophobic (typically lipophilic) group). A single surfactant may be used, or a combination of surfactants may be used. Numerous surfactants are known to those skilled in the art. See, e.g., McCutcheon's Volume 1: Emulsifiers & Detergents (1995 North American Edition) (MC Publishing Co., 175 Rock Road, Glen Rock, N.J. 07452). Examples of the major surfactant types that can be used to carry out the present invention include the: alcohols, alkanolamides, alkanolamines, alkylaryl sulfonates, alkylaryl sulfonic acids, alkylbenzenes, amine acetates, amine oxides, amines, sulfonated amines and amides, betaine derivatives, block polymers, carboxylated alcohol or alkylphenol ethoxylates, carboxylic acids and fatty acids, diphenyl sulfonate derivatives; ethoxylated alcohols, ethoxylated alkylphenols, ethoxylated amines and/or amides, ethoxylated fatty acids, ethoxylated fatty esters and oils, fatty esters, fluorocarbon-based surfactants, glycerol esters, glycol esters, hetocyclic-type products, imidazolines and imidazoline derivatives, isethionates, lanolin-based derivatives, lecithin and lecithin derivatives, lignin and lignin deriviatives, maleic or succinic anhydrides, methyl esters, monoglycerides and derivatives, olefin sulfonates, phosphate esters, phosphorous organic derivatives, polyethylene glycols, polymeric (polysaccharides, acrylic acid, and acrylamide) surfactants, propoxylated and ethoxylated fatty acids alcohols or alkyl phenols, protein-based surfactants, quaternary surfactants, sarcosine derivatives, silicone-based surfactants, soaps, sorbitan derivatives, sucrose and glucose esters and derivatives, sulfates and sulfonates of oils and fatty acids, sulfates and sulfonates ethoxylated alkylphenols, sulfates of alcohols, sulfates of ethoxylated alcohols, sulfates of fatty esters, sulfonates of benzene, cumene, toluene and xylene, sulfonates of condensed naphthalenes, sulfonates of dodecyl and tridecylbenzenes, sulfonates of naphthalene and alkyl naphthalene, sulfonates of petroleum, sulfosuccinamates, sulfosuccinates and derivatives, taurates, thio and mercapto derivatives, tridecyl and dodecyl benzene sulfonic acids, etc.

As will be apparent to those skilled in the art, numerous additional ingredients can be included in the dry-cleaning medium, including detergents, bleaches, whiteners, softeners, sizing, starches, enzymes, hydrogen peroxide or a source of hydrogen peroxide, fragrances, etc.

In practice, one or more articles to be cleaned and a liquid dry cleaning medium as given above are combined in the basket and the door sealed to the body member to form a closed wash tank. The liquid dry cleaning composition is preferably provided in an amount so that the wash tank contains both a liquid phase and a vapor phase (that is, so that the drum is not completely filled with the article and the liquid composition). Liquid to cloth ratios are determined as described by W. Smith & A. Martin, *The Importance of Liquid-to-Cloth Ratio in Detergency*, (paper presented at the Joint Meeting of the American Oil Chemists Society and American Association of Cereal Chemists, Washington-Hilton Hotel, Washington, D.C., Apr. 2, 1968). The article is then agitated in the wash tank by rotation of the basket, preferably so that the article contacts both the liquid dry cleaning composition and the vapor phase, with the agitation carried out for a time sufficient to clean the article. When the wash cycle is completed, the liquid carbon dioxide cleaning medium is preferably drained from wash tank, additional carbon dioxide medium is optionally extracted from the article(s). The cleaned article is then removed from the drum.

The article may optionally be rinsed (for example, by removing the composition from the drum, adding a rinse solution such as liquid $CO_2$ (with or without additional ingredients such as water, co-solvent, etc.) to the drum, agitating the article in the rinse solution, removing the rinse solution, and repeating as desired), after washing and any extraction step, before it is removed from the drum. The dry cleaning compositions and the rinse solutions may be removed by any suitable means, including both draining and venting.

Figure 13:
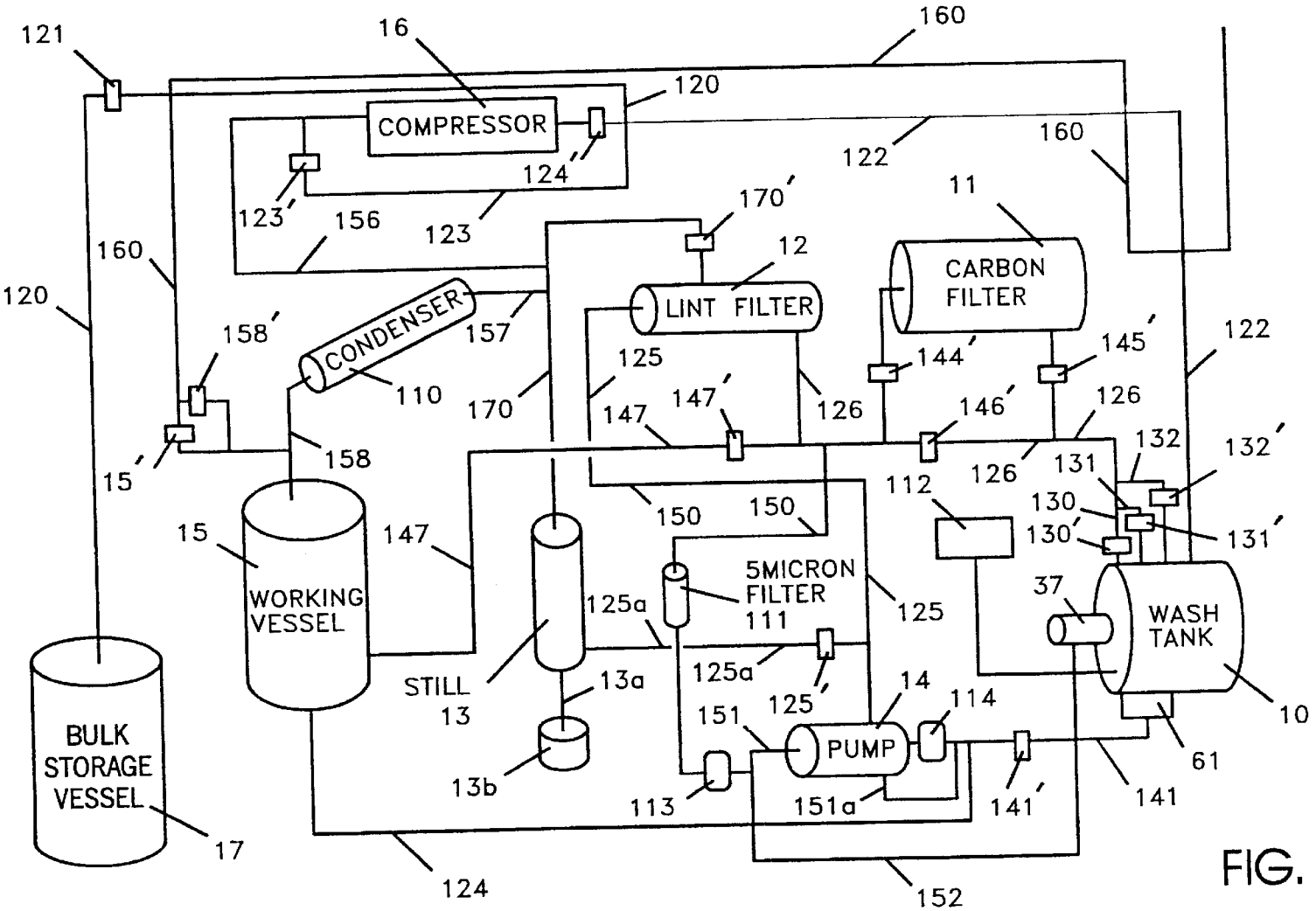
FIG. 13 is a schematic view of an apparatus of the present invention.

FIG. 13 schematically illustrates a system that can be used to carry out the present invention. The system includes a wash tank 10, a carbon filter 11, a lint filter 12, a still 13, a pump 14, a working vessel 15, a compressor 16, and a bulk storage vessel 17, all as noted in conjunction with FIGS. 1–2 above. In addition, a condenser 110, a particulate filter suitable for reducing the flow of damaging particles to the pump such as 5 micron filter 111, an edductor 112 such as a Penberthy edductor (or other suitable fan, blower, or venting mechanism), and chillers 113, 114 are also shown. Valves and lines for carrying out the various stages of operation of the apparatus are also shown, as discussed in greater detail below.

It will be noted that the system of the invention is a closed system, with gas communication being provided where necessary through lines that are closed to the atmosphere. Carbon dioxide gas or carbon dioxide dry cleaning medium are transferred from one location to the other within the by means such as pumping, compressing, condensing, gravity, and combinations thereof, with gas communication provided where necessary to facilitate such transfer. Advantageously, the system does not employ a second gas such as nitrogen to force gas or medium from one location to another, as in some prior art systems.

Once the door to the wash tank 10 is closed and sealed with the articles to be cleaned contained therein, the wash tank is initially charged with carbon dioxide gas to about 50 psi at ambient temperature from bulk storage vessel 17 via line 120 through valve 121 to line 122 into wash tank 10.

To fill the wash tank (which preferably has a capacity of 100 to 150, and most preferably 145, gallons and is filled half-way with liquid carbon dioxide cleaning medium), liquid carbon dioxide cleaning medium is pumped from working vessel 15 through line 124 to pump 14, and then by line 125 through lint filter 12 and line 126 and into the wash tank through any one, or combination of, of lines 130, 131, and 132 (forward rotate, reverse rotate, or direct release onto the basket, respectively, by ports 51, 53, and 55 respectively of the wash tank as illustrated in FIGS. 3–5) under control of valves 130', 131', and 132'. Gas-side communication between working vessel 14 and wash tank 10 is provided via line 122 (connected to port 54) and 123 through valve 123', and then by line 156 and 157 through condenser 110 and by line 158 to working vessel 15.

Advantages of providing gas-side communication include prevention of concentration of solutes in the working vessel, reduction of undesired heating of the medium in the working vessel, prevention of dilution of solutes in the wash tank, reduction of undesired cooling in the wash tank, and reduction of potential cavitation in pump 14 and damage to the pump.

It is preferred to direct at least a portion of the initial fill volume through forward rotation line 130 so that the spinning of the basket is initiated before the clothes become saturated with cleaning medium (note that the designation of forward and reverse is arbitrary herein; the forward direction may be either clockwise or counter clockwise).

With lines 130–132 and valves 130'–132', the rotation of the basket can be periodically reversed, or the speed of rotation can be allowed to periodically accelerate or deccelerate, to agitate the articles in the basket and reduce twisting or knotting of articles contained within the rotating basket.

Once the filling step is completed the wash cycle can be initiated (it being appreciated that some "washing" occurs during the fill cycle). During the wash cycle, liquid medium is drained from the wash tank 10 via drain 140 and drain line 141 through chiller 114 to pump 14, and then through line 125 to the lint filter and into the wash tank as during the fill step. During the first period of the wash cycle (typically about two minutes) valves 144' and 145' are closed and valve 146' is open so that the carbon filter is locked out of the cycle. This prevents soap elements and other elements in the cleaning medium from initially adhering to and being trapped within 30 the carbon filter. After the initial period, valves 144' and 145' are opened and valve 146' is closed, and the liquid medium is thereby passed through the carbon filter 11 before being returned to the wash tank 10.

The lint filter is preferably a bag filter, and is separate from the carbon filter. However, the choice of filtering mechanism is not critical, and different filters can be employed, the filters could be consolidated together, etc.

After the wash step, liquid medium is drained from the wash tank by closing valve 146' and opening valve 147', so that liquid medium pumped through the lint filter is returned by line 147 to working vessel 15. Importantly, liquid should be drained just out of the wash tank (e.g., to about the level of the drain 61), so that the pump will not be run dry or cavitate and be damaged. The level of the liquid carbon dioxide cleaning medium can be determined by using indicators or switches based on capacitance, conductance, differential pressure, optoelectronics, fiber optics, sonics, ultrasonics, visual observation, float levels, magnetic switches, by using a flow meter to calculate the amount of fluid being transported, etc.

After the draining step, valve 147' is closed and the pump run with the stream directed through the forward or reverse nozzle (lines 130 or 131), with the basket being spun at about 200 to 350 revolutions per minute for from 1 to 3 minutes. This extraction step removes excess liquid medium from the articles within the basket.

An advantage of the instant system is the manner by which the pump and wash tank bearings are lubricated. A line 150 takes a portion of the liquid carbon dioxide cleaning medium exiting the lint filter, passes that portion through a particle filter 111, passes that portion through a chiller 113, and then splits the flow and directs a portion to the canned motor of pump 14 by line bearing flush line 151 to lubricate the canned motor, and directs another portion to the wash tank bearing cartridge 37 by line 152. Since line 150 is taken off of line 126 from the lint filter, which spins the basket in the wash tank, and since line 125 passes directly from the pump to the lint filter and to line 126, line 150 will receive liquid flow whenever the pump is running and the wash basket is spinning, insuring that the pump motor and basket bearings are being separately lubricated whenever they are active. The cooling of this side-stream via chiller 113 serves to further protect the motor and bearings.

The canned motor pump 14 contains the canned motor pump and a turbine pump head driven by the canned motor. The pump is itself enclosed in a pressure vessel. The bearing flush outlet for the canned motor is provided by bearing flush outlet line 151*a,* which is returned to line 141.

After the spin cycle, liquid medium is drained from the wash vessel to a level below the rotating basket, and preferably below valve 141', and returned to the working vessel. Since a significant amount of carbon dioxide remains in the wash tank as a relatively high pressure gas (e.g., 200 or 300 psi to 500 to 900 psi; or stated otherwise, at vapor pressure or up to 100 psi below vapor pressure for the gas at the temperature of the system in wash tank 10), valve 141' is closed to isolate the wash tank, valve 123' is closed, valve 124' is opened, and the gas within wash tank 10' is pumped by compressor 16 out line 156 to line 157 and through the condenser 110 and back into the working vessel by line 158. Valve 158' is closed for this step, and valve 15' is a pressure release valve to vent header line 160. Valve 141' is preferably a butterfly valve such as a high-performance butterfly valve available from Neles-Jamesbury, 640 Lincoln Street, Worcester, Mass. 01615.

Next, still 13 is filled with 8 to 10 gallons of liquid medium by draining the contents of lint filter 12 through line 125 through valve 125' and line 125*a*. Gas-side communication is provided between the still and the lint filter through line 170 by opening valve 170'. The still is activated and distilled carbon dioxide gas passes by line 170 to line 157 (valve 170' has been closed) and condenser 110 to line 158 and working vessel 15. Waste is drained from still 13 by line 13*a* into waste receptacle 13*b*.

Suitable chilling can be provided by a heat exchanger, such as a glycol chiller system, in accordance with conventional techniques, or any other heat exchange system that reduces the temperature of the medium. Suitable pressure release valves are incorporated into the system for all pressure vessels in accordance with standard safety protocols.

In an alternate embodiment of the invention, the separate distillation tank or still 13 is removed and this function performed by other apparatus within the system. This provides a physical advantage by removing a tank and thereby creating an overall smaller unit. Even though a separate still is removed, the distillation step must occur somewhere in the system. Two options are available. First, the still can be incorporated between the wash tank and valve 141'. At the end of the wash cycle, all but a small portion (7–10 gallons) of liquid medium is transferred to the working tank (e g., the volume of the drain 61 and line 141 up to valve 141'). The remainder left in the wash tank/still is distilled by turning on compressor 16 and carrying out the distillation right in drain 61. When distilling the carbon dioxide, the vapors will travel through the wash tank and over to the condenser 110. This creates an additional advantage by using the wash tank 10 itself as a reflux column. As pure carbon dioxide distilled from the button tank travels through the wash tank, a portion will condense on articles contained within the wash tank basket. This condensation acts as a pure carbon dioxide rinse or vapor degreaser, thereby increasing the cleaning performance of the system.

A second alternative is to incorporate the still with the lint filter. The method described above drains the lint filter into the still after each run. Rather than draining and then distilling this fluid in the still, the lint filter can be modified to accomplish the distillation. The lint filter is changed from a bag-type filter to a self-leaning filter. At the end of each run, a valve at the bottom of the filter housing is opened to purge the lint from the filter. By changing this filter to a self-cleaning type, the operator is no longer required to periodically change filter bags. This would also save down time and labor when the bags would normally have to be changed. At this point the carbon dioxide left inside the filter housing would be distilled. Any waste in the CO2 would collect in the bottom of the filter and be removed by actuating the valves at the bottom of the filter housing.

The foregoing is illustrative of the present invention, and is not to be construed as limiting thereof. The invention is defined by the following claims, with equivalents of the claims to be included therein.

That which is claimed is:

1. A method of operating a cleaning apparatus adapted for use with a carbon dioxide cleaning medium, comprising:

providing a working vessel to supply carbon dioxide cleaning medium and a wash tank to receive carbon dioxide cleaning medium, said wash tank including a drain and a rotating basket, said rotating basket containing articles to be cleaned;

partially filling said wash tank by transferring liquid carbon dioxide cleaning medium from said working vessel to said wash tank so that said wash tank contains a liquid phase and a gas phase and to at least partially immerse said articles to be cleaned in said carbon dioxide cleaning medium;

washing said articles by pumping liquid carbon dioxide cleaning medium from said wash tank drain through at least one filter and back into said wash tank as a stream of liquid carbon dioxide cleaning medium while rotating said basket so that said articles contact both said liquid phase and said gas phase, and while chilling said stream of liquid carbon dioxide cleaning medium prior to pumping said stream of liquid carbon dioxide cleaning medium; then draining said liquid carbon dioxide cleaning medium from said wash tank back to said working vessel so that said articles to be cleaned are no longer immersed in said liquid carbon dioxide cleaning medium; and then extracting liquid carbon dioxide cleaning medium from said articles by spinning said basket; wherein gas phase communication is provided between said working vessel and said wash tank during said partially filling step; and wherein gas phase communication is provided between said wash tank and said working vessel during said draining step.

2. A method according to claim 1, wherein said partially filling step is carried out by pumping liquid carbon dioxide cleaning medium from said working vessel to said wash tank.

3. A method according to claim 1, wherein said extracting step is followed by the step of:

recapturing carbon dioxide from said wash tank by transferring high pressure carbon dioxide gas from said wash tank back to said working vessel.

4. A method according to claim 3, wherein said step of transferring high pressure carbon dioxide gas is carried out by compressing, by condensing, or by combinations thereof.

5. A method according to claim 3, wherein said recapturing step is followed by the step of:

displacing low pressure carbon dioxide gas from said wash tank, after which said wash tank may be opened.

6. A method according to claim 3, wherein said recapturing step is followed by the step of:

blowing carbon dioxide gas remaining in said wash tank out of the vessel with air before said vessel is opened.

7. A method according to claim 1, said partially filling step being carried out by transferring at least a portion of said liquid carbon dioxide cleaning medium into said wash tank as a stream of liquid carbon dioxide cleaning medium, with said basket being rotated by said stream, so that rotation of said basket is initiated prior to said washing step.

8. A system for cleaning articles with a carbon dioxide cleaning medium, comprising:

a working vessel for supplying carbon dioxide cleaning medium;

a wash tank for receiving carbon dioxide cleaning medium, said wash tank having a rotating basket disposed therein, said wash tank including a drain;

a fill line connecting said working vessel to said wash tank;

a pump positioned on said fill line for pumping liquid carbon dioxide cleaning medium from said working vessel to said wash tank;

a gas communication line connecting said working vessel to said wash tank; and a drain line connecting said wash tank to said pump.

9. An system according to claim 8, further comprising:

a recapture line connecting said wash tank to said working vessel; and a compressor positioned on said recapture line for pumping carbon dioxide gas from said wash tank to said working vessel.

10. A system according to claim 8, further comprising:

vent means connected to said wash tank for venting low pressure carbon dioxide gas therefrom.

11. A system according to claim 8, further comprising at least one filter positioned on said wash line.

12. A system according to claim 8, further comprising:

a chiller operatively associated with said pump upstream of said pump; said drain line connecting said wash tank to said pump through said chiller.

* * * * *